US010752018B2

(12) United States Patent
Suzuki

(10) Patent No.: US 10,752,018 B2
(45) Date of Patent: Aug. 25, 2020

(54) PRINTING APPARATUS, PRINTING METHOD AND NON-TRANSITORY STORAGE MEDIUM

(71) Applicant: CASIO COMPUTER CO., LTD., Shibuya-ku, Tokyo (JP)

(72) Inventor: Shigeto Suzuki, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/358,004

(22) Filed: Mar. 19, 2019

(65) Prior Publication Data

US 2019/0291464 A1 Sep. 26, 2019

(30) Foreign Application Priority Data

Mar. 20, 2018 (JP) ..... 2018-052026

(51) Int. Cl.
*B41J 3/36* (2006.01)
*B41J 2/01* (2006.01)
*B41J 29/38* (2006.01)

(52) U.S. Cl.
CPC . *B41J 3/36* (2013.01); *B41J 2/01* (2013.01); *B41J 29/38* (2013.01)

(58) Field of Classification Search
CPC ..... B41J 3/36; B41J 29/38; B41J 2/01; H04N 1/107
USPC ..... 347/109
See application file for complete search history.

(56) References Cited

U.S. PATENT DOCUMENTS

2008/0215286 A1* 9/2008 Mealy ..... B41J 3/36 702/150

FOREIGN PATENT DOCUMENTS

JP 2004508218 A 3/2004

* cited by examiner

*Primary Examiner* — Huan H Tran
*Assistant Examiner* — Alexander D Shenderov
(74) *Attorney, Agent, or Firm* — Holtz, Holtz & Volek PC

(57) ABSTRACT

A printing apparatus includes: a printer head that prints, in accordance with a movement of the printing apparatus by a user within a printing region of a printing medium, a print-target image on the printing medium; a plurality of sensors each capable of sensing a displacement of the printing apparatus; and a processor that determines, based on the displacement sensed by the sensor, a position of the printing apparatus relative to the printing region, and switches, among the plurality of sensors, a sensing state of a sensor that is sensing the displacement and a sensing state of a sensor that is not sensing the displacement, in accordance with the determined position of the printing apparatus.

10 Claims, 11 Drawing Sheets

PRINTING APPARATUS, PRINTING METHOD AND NON-TRANSITORY STORAGE MEDIUM

CROSS-REFERENCE TO RELATED APPLICATION

This application claims the benefit of Japanese Patent Application No. 2018-052026, filed on Mar. 20, 2018, the entire disclosure of which is incorporated by reference herein.

FIELD

This application relates generally to a printing apparatus, a printing method, and a non-transitory storage medium.

BACKGROUND

National Publication No. 2004-508218 discloses a handheld-type printing apparatus that allows a user to manually scan to execute printing. This handheld-type printing apparatus includes two positional sensors that operate in conjunction with a printer head. The positional sensors measure, in real time, where the handheld-type printing apparatus is positioned in a printing process. According to such a handheld-type printing apparatus, by providing a plurality of positional sensors, detection of a change in the position of the printing apparatus and of a change in the angle is enabled.

SUMMARY

A printing apparatus according to the present disclosure includes:

a printer head that prints, in accordance with a movement of the printing apparatus by a user within a printing region of a printing medium, a print-target image on the printing medium;

a plurality of sensors each capable of sensing a displacement of the printing apparatus; and a processor that determines, based on the displacement sensed by the sensor, a position of the printing apparatus relative to the printing region, and switches, among the plurality of sensors, a sensing state of a sensor that is sensing the displacement and a sensing state of a sensor that is not sensing the displacement in accordance with the determined position of the printing apparatus.

BRIEF DESCRIPTION OF THE DRAWINGS

A more complete understanding of this application can be obtained when the following detailed description is considered in conjunction with the following drawings, in which.

DETAILED DESCRIPTION

Embodiment 1

Figure 1A:
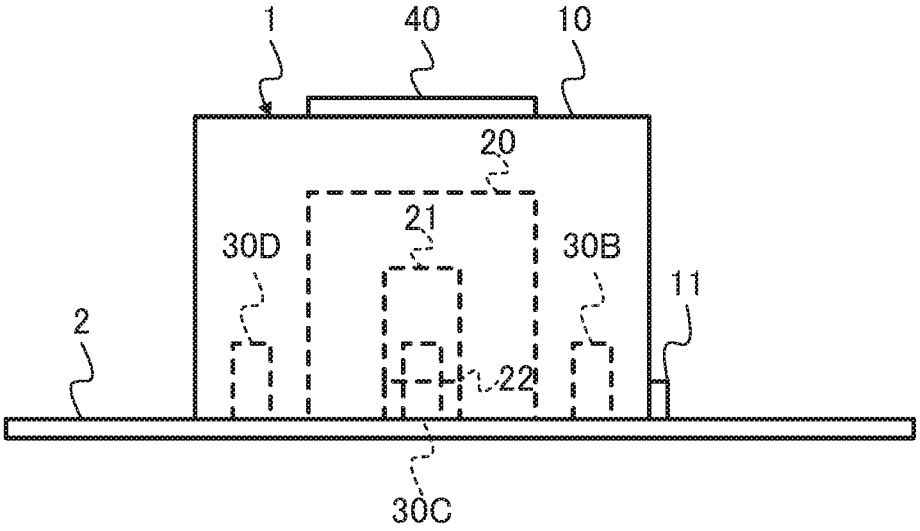
FIG. 1A is a side view of a printing apparatus according to Embodiment 1.

A printing apparatus 1 according to Embodiment 1 will be described with reference to the figures. Note that the same or corresponding portion in the figures will be denoted by the same reference numeral.

Figure 1B:
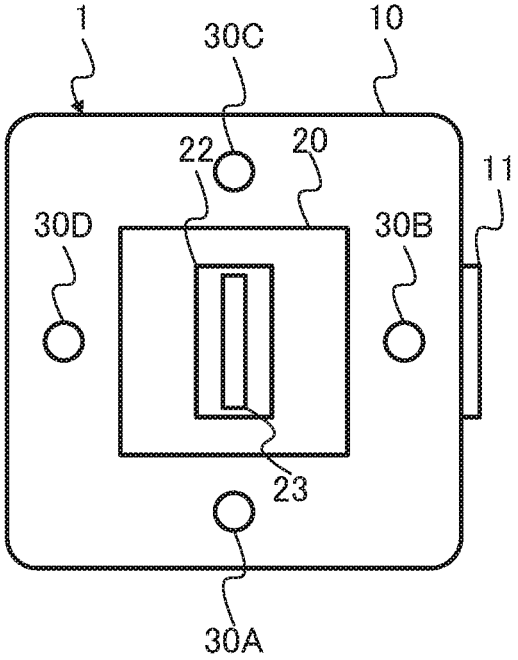
FIG. 1B is a bottom view of the printing apparatus according to Embodiment 1.

FIG. 1A is a side view of a printing apparatus according to Embodiment 1, and FIG. 1B is a bottom view of the printing apparatus according to Embodiment 1. The printing apparatus 1 is a manual scan type printing apparatus which prints a print-target image 3 on a printing medium 2 with the printing apparatus 1 being held by a user and being moved over the printing medium 2. Such a manual scan type printing apparatus may be called a handy printer, a handheld printer, and a mobile printer.

The printing medium 2 is a medium on which the print-target image 3 is printed by the printing apparatus 1. The printing medium 2 is also called a recording medium or a print object. The printing medium 2 includes a printing paper, a printing label, a cardboard, and may be typically formed of paper and resin, but not limited to these examples. The printing medium 2 may be any media as long as such media have a surface on which the printing apparatus 1 can execute the printing.

The print-target image 3 is a print-target image by the printing apparatus 1 on the printing medium 2. The print-target image 3 is also called a printing image or a printing pattern. Although the print-target image 3 may include a character, a symbol, a graphic, a pattern, a drawing, and a photograph, such an image is not limited to these examples.

Figure 2:
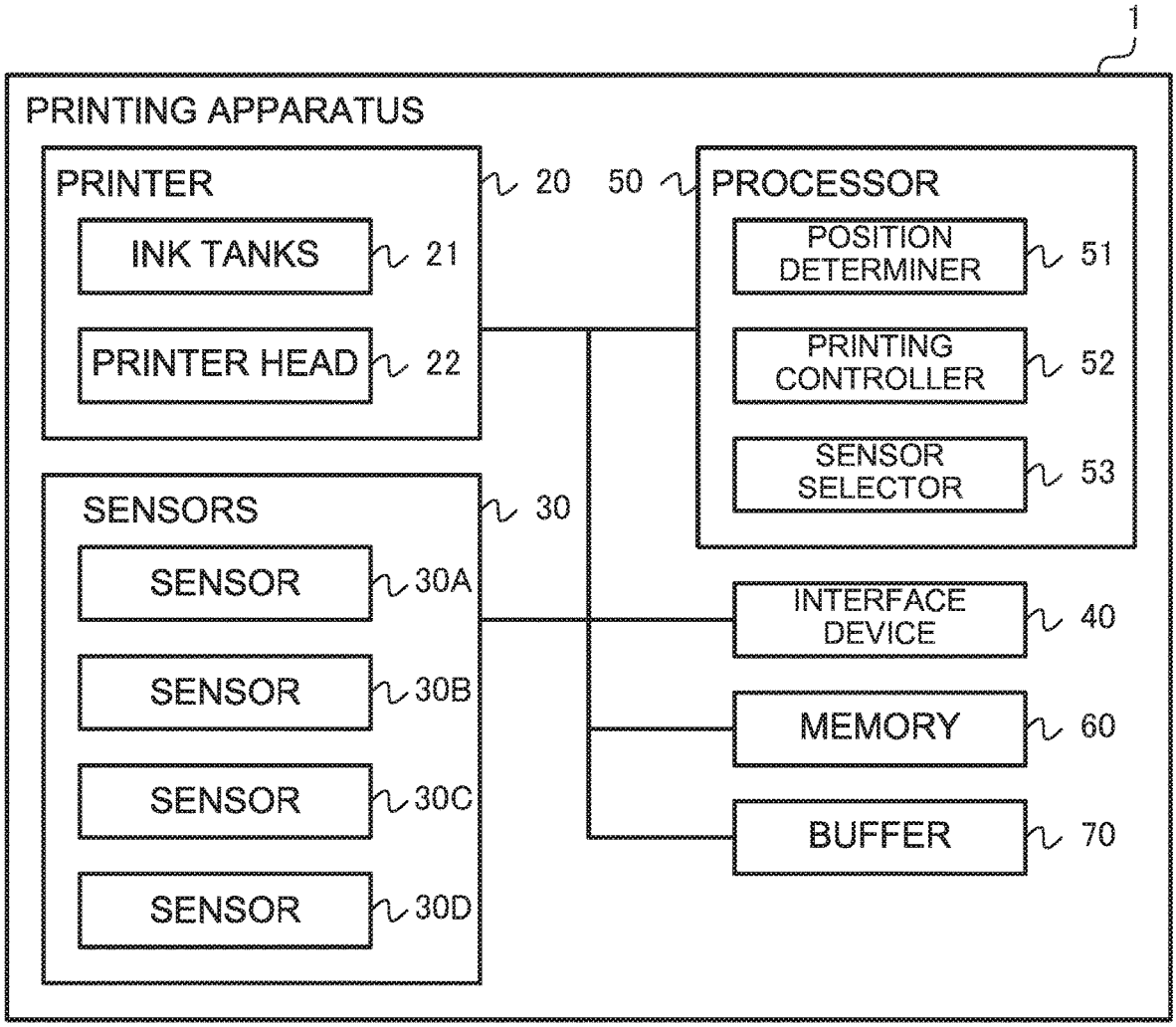
FIG. 2 is a block diagram illustrating a structure of the printing apparatus according to Embodiment 1.

FIG. 2 is a block diagram illustrating a structure of the printing apparatus 1. As illustrated in FIGS. 1A and 2, the printing apparatus 1 includes a casing 10, a printer 20, a sensor 30, an interface device 40, a processor 50, a memory 60, and a buffer 70.

The casing 10 houses therein the printer 20, the sensor 30, the interface device 40, the processor 50, and the memory 60 which are components of the printing apparatus 1. As illustrated in FIGS. 1A and 1B, the printer 20, the sensor 30, and the interface device 40 are exposed from the casing 10. Although the casing 10 is formed of a resin or a metal, the material is not limited to these examples. The casing 10 includes a marker 11 on a surface adjacent to a surface on which the printer 20 is placed. The casing 10 is also called a main body 10. Although the casing 10 includes therein a substrate, a battery, and the like, illustrations thereof are omitted.

The marker 11 is a reference that indicates a width of a printer head 22 of the printer 20 and a printing start position to be described later for the user. A width of the marker 11 is equal to a width of the printer 20.

The printer 20 is placed on a surface of the casing 10 to be in contact with the printing medium 2, and prints the print-target image 3 on the printing medium 2. The printer 20 includes ink tanks 21 filled with respective inks, and the printer head 22 which forms droplets of the ink filled in the ink tank 21 and which discharges the ink droplets, thus executing an inkjet printing. The ink tank 21 supplies the ink to the printer head 22. The printer head 22 includes a plurality of nozzles 23 that is arranged side by side along a main scanning direction and along a sub scanning direction. The printer head 22 heats the ink in each nozzle 23 by a heater to form ink bubbles, and discharges the inks onto the printing medium 2 from the respective nozzles 23 by the produced ink bubbles.

The sensor 30 includes four sensors 30A, 30B, 30C, and 30D. The four sensors 30A to 30D are placed at four sides, respectively, on the lower surface of the printing apparatus 1 so as to surround the printer 20, and measure, at the respective positions, relative displacements (or moving distances) to the printing medium 2. In accordance with the sensing result by the sensor 30, the printing apparatus 1 can grasp where the printing apparatus 1 is positioned relative to the printing medium 2. While the printing apparatus 1 is moving under a predetermined condition over the printing medium 2, the processor 50 selects two sensors that sense the displacements at the respective sensor positions and the remaining two sensors that do not execute the sensing in accordance with the situation among the four sensors 30A to 30D. More specifically, as illustrated in FIG. 2, the sensors 30A to 30D each include a Light Emitting Diode (LED) and an image sensor, and cause the image sensor to read light which is emitted from the LED and which is reflected by the printing medium 2 to compare reflected lights before and after the movement, thereby measuring the displacement of the printing apparatus 1 and the direction thereof. The sensor 30 provides, to the processor 50, data containing the measured displacement and direction.

The interface device 40 receives a user's input that includes instructions for starting and ending the printing, and presents information to the user. The interface device 40 provides, to the processor 50, the received instructions for starting and ending the printing, and for whether or not to add a contour line, and presents the information obtained from the processor 50 to the user. Although the interface device 40 may include buttons, keys or a touch pad that receives a user's input, a liquid crystal display or a speaker that presents information to the user, or a touch panel that accomplishes both the functions, the components of the interface device 40 are not limited to these examples.

The processor 50 controls the printing apparatus 1 by executing a program for the printing apparatus 1. Note that the program data may be stored in the memory 60 to be described later, or may be stored in a non-transitory storage medium connected to an unillustrated external connection interface in the printing apparatus 1. The processor 50 includes a position determiner 51, a printing controller 52, and a sensor selector 53. The processor 50 includes a Central Processing Unit (CPU), but may include other components.

The position determiner 51 determines whether or not, in an initial state, the four sensors 30A to 30D are positioned over the printing medium 2 in accordance with the received lights. At this time, when determining that equal to or greater than two sensors 30A to 30D are positioned over the printing medium 2, the processor 50 determines as printable. When being unmovable, the printing apparatus 1 informs the user of the unmovable state by sounds or by turning on an unillustrated indicator, and the like.

When the interface device 40 receives the instruction for stating the printing, the printing controller 52 controls the printer 20 to start printing the print-target image 3. At this time, the casing 10 is held by the user and the printing apparatus 1 is moved. The printing controller 52 obtains the position of the printing apparatus 1 which is relative to the print-target image 3 and which is determined by the position determiner 51, and controls the printer 20 to print a portion of the print-target image 3 corresponding to the position of the printer 20. The printing controller 52 deactivates the printer 20 after the printer 20 finishes the printing of the print-target image 3.

When three or more sensors exist among the four sensors 30A to 30D are capable of sensing, the sensor selector 53 selects two of the three or more sensors to continue the sensing and the remaining two sensors to be deactivated. The sensor selector 53 obtains, from the position determiner 51, the position of the printing apparatus 1 relative to the print-target image 3, and selects the sensing sensors and deactivating sensors among the sensors 30 based on the obtained position.

The sensor selector 53 changes the sensing and deactivation of the sensors 30A and 30C when the printing apparatus 1 traverses a reference line 4X. Similarly, the sensor selector 53 changes the sensing and deactivation of the sensors 30B and 30D when the printing apparatus 1 traverses a reference line 4Y.

More specifically, when the user starts moving the printing apparatus 1 in a printable state over the printing medium 2 in accordance with the determination by the position determiner 51, equal to or greater than the two sensors positioned over the printing medium 2 among the sensors 30 start measuring the displacement of the printing apparatus 1. At this time, when there are equal to or greater than three sensors positioned over the printing medium 2 and capable of sensing, the sensor selector 53 controls in such a way that, along the moving direction, the one sensor near the moving direction in the sensors 30A and 30C placed at opposing positions to each other across the printer 20 and the one sensor near the moving direction in the sensors 30B and 30D placed at the opposing positions to each other across the printer 20 continue the sensing, and the other sensors are deactivated to stop sensing. When both the sensors 30A and 30C are positioned over the printing medium 2, the sensor selector 53 selects only the one sensor near the printing direction, and when only one sensor is positioned over the printing medium 2, selects this sensor only. Similarly, when both the sensors 30B and 30D are positioned over the printing medium 2, the sensor selector 53 selects only the one sensor near the printing direction, and when only one sensor is positioned over the printing medium 2, selects this sensor only. When both the sensors 30A and 30C are near the printing direction and positioned over the printing medium 2, the sensor selector 53 is set so as to cause only one arbitrary sensor to execute the sensing. Similarly, when both the sensors 30B and 30D are near the printing direction and positioned over the printing medium 2, the sensor selector 53 is set so as to cause only one arbitrary sensor to execute the sensing. The position determiner 51 obtains the displacement of the printing apparatus 1 measured by the sensor 30, and adds the displacement to the position of the printing apparatus 1 before the movement as needed, thereby determining the position of the printing apparatus 1 after the movement. The processor 50 sets the initial position of the printing apparatus 1 to, for example, an upper left vertex of the print-target image 3, and the position determiner 51 adds the displacement from this initial position, thereby determining the position of the printing apparatus 1 relative to the print-target image 3. Although the position of the printing apparatus 1 to be determined by the position determiner 51 is typically a position of the center of the lower surface of the printing apparatus 1, the present disclosure is not limited to this example.

The processor 50 grasps a printing region in accordance with image data of the print-target image 3, sets the virtual reference line 4X along the horizontal direction to the center position of the printing region in the vertical direction, and sets the virtual reference line 4Y along the vertical direction to the center position of the printing region in the horizontal direction.

The sensor selector 53 changes the sensing and deactivation of the two sensors placed across the reference line 4 among the sensing sensors 30 when the printing apparatus 1 that is printing traverses the reference line (a reference position) 4.

Figure 3:
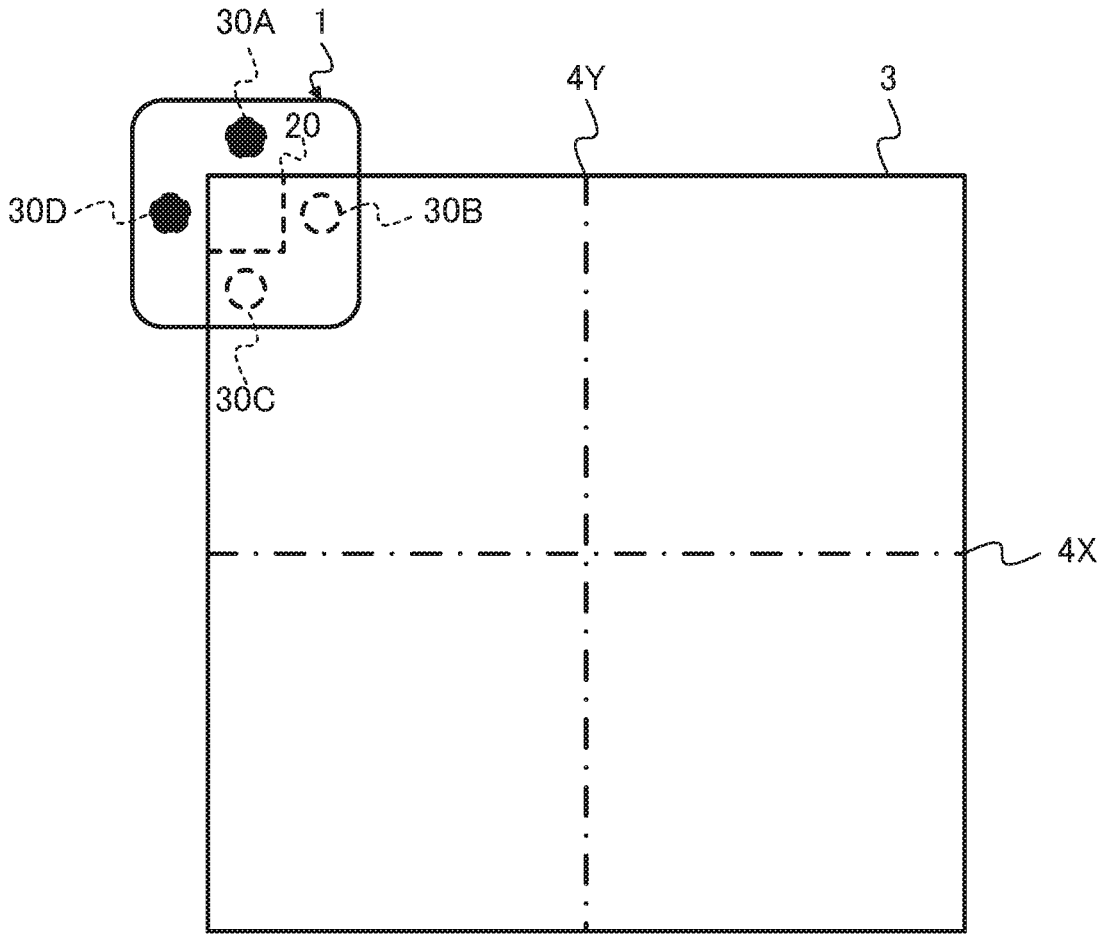
FIG. 3 is a diagram illustrating a positional relation between the printing apparatus and a print-target image according to Embodiment 1.
Figure 4:
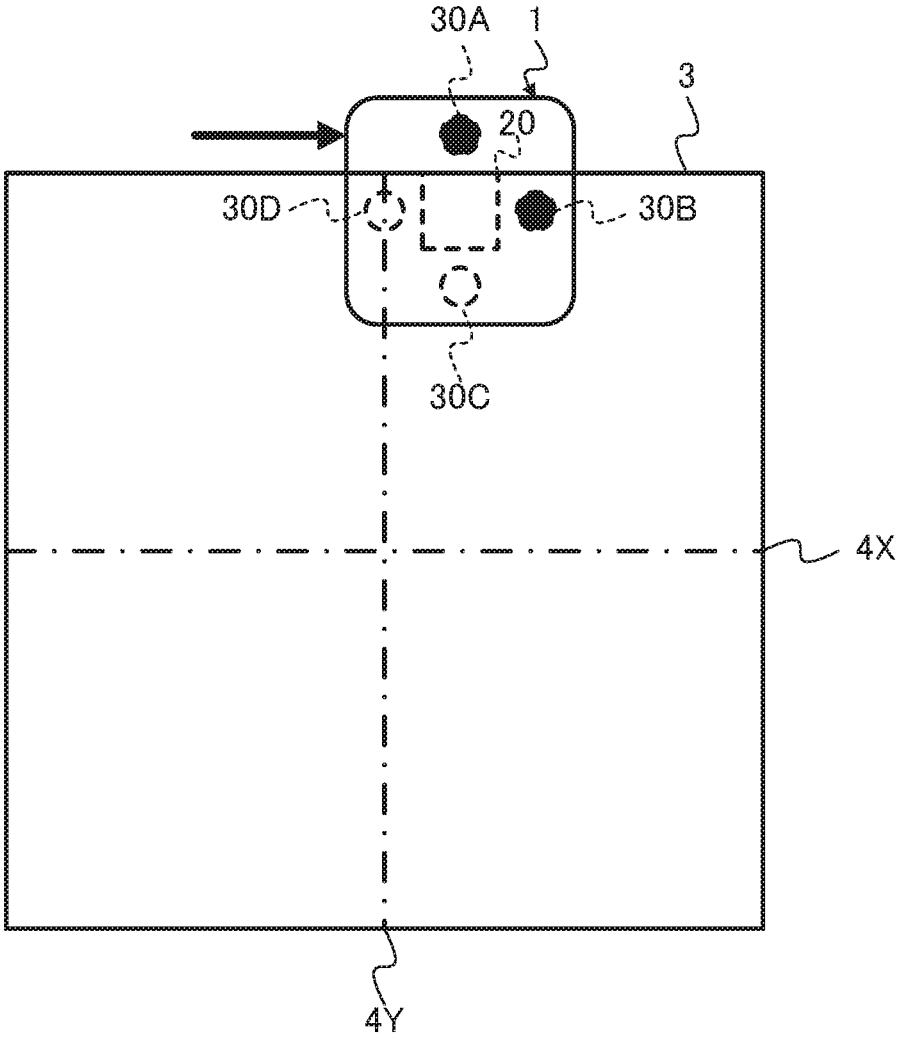
FIG. 4 is a diagram illustrating a positional relation between the printing apparatus and the print-target image according to Embodiment 1.
Figure 5:
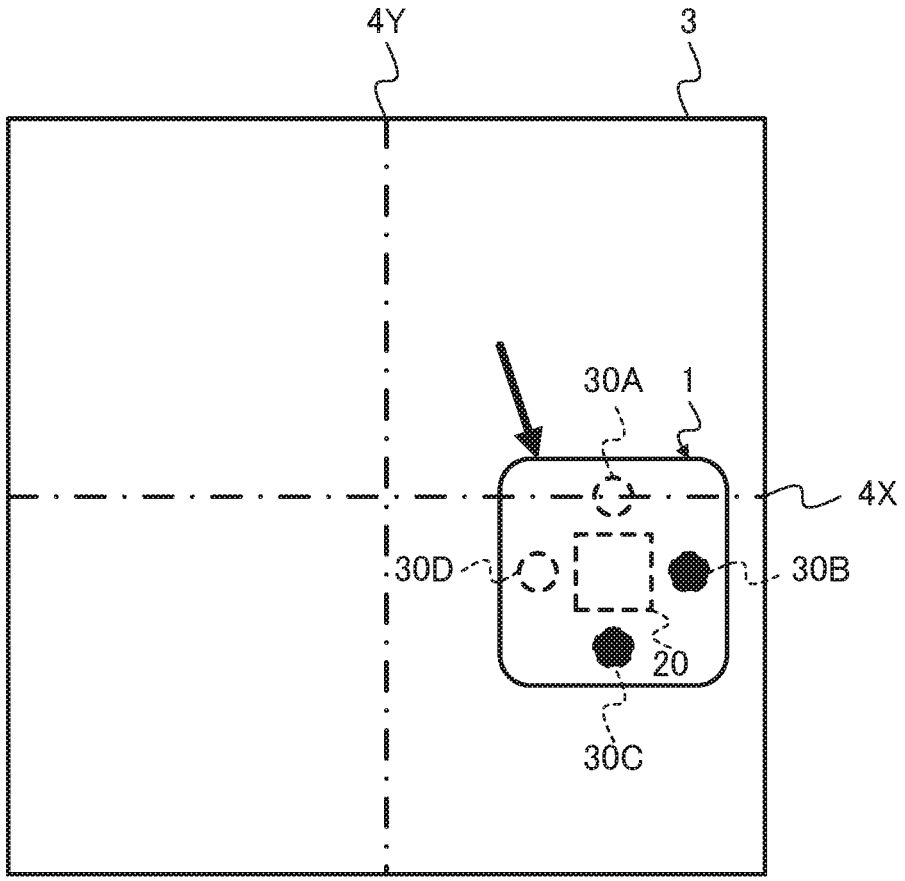
FIG. 5 is a diagram illustrating a positional relation between the printing apparatus and the print-target image according to Embodiment 1.

FIGS. 3 to 5 are diagrams illustrating a positional relation between the printing apparatus 1 and the print-target image 3. In the figures of the printing apparatus 1 as viewed from the top, the upper side (30A-side), the lower side (30C-side), the left side (30D-side), and the right side (30E-side) relative to the center of the printing apparatus 1 will be defined as the upper side, lower side, left side, and right side of the printing apparatus 1, respectively, for the purpose of description. Note that the expression over the printing medium 2 means above the printing medium 2 in the literature, and is a position in the vertical direction to the surface direction of the figure relative to the printing medium 2. In FIGS. 3 to 5, the white sensors among the sensors 30 indicate the sensors that executes sensing, and the black sensors indicate the deactivated sensors. As illustrated in FIG. 3, when, for example, the printing apparatus 1 starts printing, the sensor selector 53 selects, in the upper left side of the print-target image 3, only the sensor 30B positioned over the printing medium 2 and near the moving direction in the sensors 30B and 30D to continue the sensing, and deactivates the sensor 30D. Moreover, the sensor selector 53 selects only the sensor 30C positioned over the printing medium 2 in the sensors 30A and 30C to continue the sensing, and deactivates the sensor 30A.

As illustrated in FIG. 4, when the processor 50 determines that, in accordance with the sensing result by the sensor 30, the printing apparatus 1 which is being held by the user and which is moved in the direction of an arrow in the figure traverses the reference line 4Y and reaches the right side relative to the center of the printing medium 2, the sensor selector 53 selects the deactivated sensor 30D positioned at the left side of the printing apparatus 1 to execute the sensing, and deactivates the sensing sensor 30B positioned at the right side of the printing apparatus 1.

Next, as illustrated in FIG. 5, when the processor 50 determines that, in accordance with the sensing result by the sensor 30, the printing apparatus 1 which is being held by the user and which is moved in the direction of an arrow in the figure traverses the reference line 4X and reaches the lower side relative to the center of the printing medium 2, the sensor selector 53 selects the deactivated sensor 30A which is positioned over the printing medium 2 and which is positioned at the upper side of the printing apparatus 1 to execute the sensing, and deactivates the sensing sensor 30C positioned at the lower side of the printing apparatus 1.

Conversely to FIG. 4, when the processor 50 determines that, in accordance with the sensing result by the sensor 30, the printing apparatus 1 which is being held by the user and which is moved traverses the reference line 4Y and reaches the left side relative to the center of the printing medium 2, the sensor selector 53 selects the deactivated sensor 30B that is positioned at the right side of the printing apparatus 1 to execute the sensing, and deactivates the sensing sensor 30D that is positioned at the right side of the printing apparatus 1.

Conversely to FIG. 5, when the processor 50 determines that, in accordance with the sensing result by the sensor 30, the printing apparatus 1 which is being held by the user and which is moved traverses the reference line 4X and reaches the upper side relative to the center of the printing medium 2, the sensor selector 53 selects the deactivated sensor 30C that is positioned at the lower side of the printing apparatus 1 to execute the sensing, and deactivates the sensing sensor 30A that is positioned at the upper side of the printing apparatus 1.

As described above, the sensor selector 53 causes, among the sensors 30, the sensor positioned relatively to the center side of the print-target image 3 to execute the sensing, and deactivates the sensor positioned relatively at the external side.

The memory 60 reads the program in the non-transitory storage medium for causing the processor 50 to execute a process, stores the read program together with other data, and functions as a work area for the processor 50 that executes the process. The memory 60 may store a program of a non-transitory storage medium for controlling the printer 20 to execute the printing, a program of a non-transitory storage medium for controlling the sensor 30 to measure the displacement, data on the coordinates of the printer 20 and on the print-target image 3, and the like, but the information and the like to be stored are not limited to these examples. Although the memory 60 may include a Read Only Memory (ROM) and a Random Access Memory (RAM), the component of the memory 60 is not limited to these examples.

The buffer 70 temporarily stores data on the print-target image 3. The buffer 70 obtains and stores the data on the print-target image 3 from the memory 60, and provides, to the printing controller 52, the data on a portion to be printed. When providing, to the printing controller 52, the data on the print-target image 3, the buffer 70 then erases the provided portion in the stored data on the print-target image 3. When the entire print-target image is printed, all pieces of the data on the print-target image 3 and being stored in the buffer 70 are erased. Although the buffer 70 may include a RAM, the component of the buffer 70 is not limited to this example.

Figure 6:
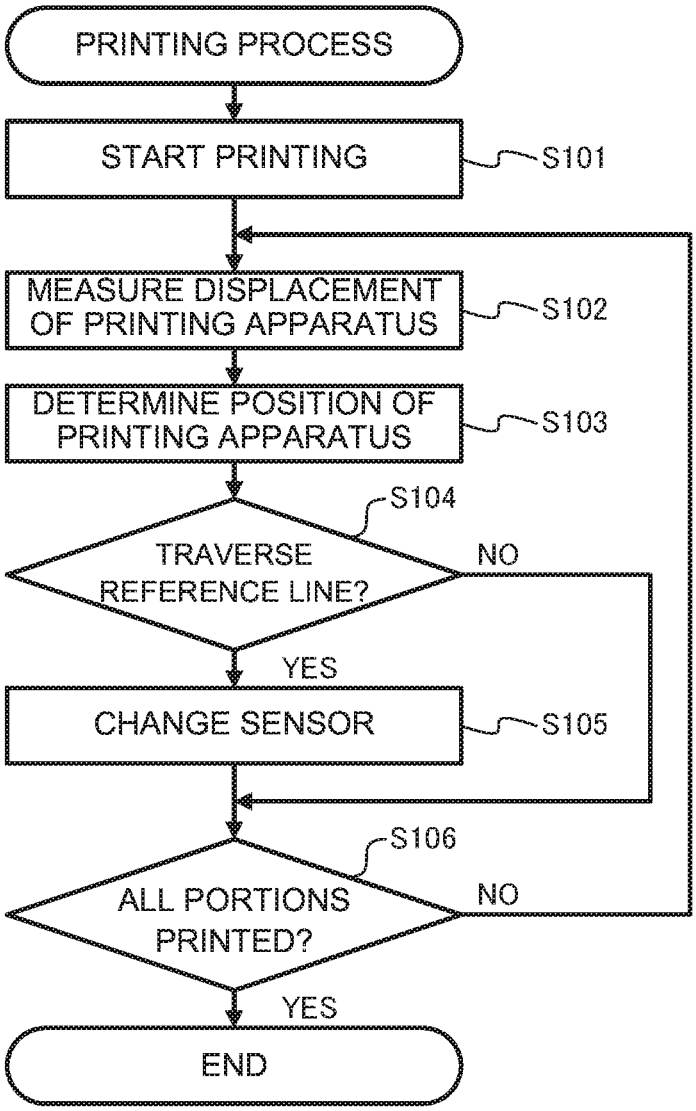
FIG. 6 is a flowchart for a printing process executed by the printing apparatus according to Embodiment 1.

A printing process executed by the printing apparatus 1 according to Embodiment 1 will be described. FIG. 6 is a flowchart for the printing process executed by the printing apparatus 1. With reference to a flowchart that is FIG. 6, the printing process will be described.

The interface device 40 receives an instruction for starting the printing from the user, and after the processor 50 obtains the instruction for starting the printing from the interface device 40, when the processor 50 determines that, based on the sensing result by the sensor 30, the printing apparatus 1 is in a printable state on the printing medium 2, and when the user moves the printing apparatus 1 over the printing medium 2, the printing process starts. The printing starts when the printing controller 52 controls the printer 20 (step S101). For example, the printing starts from the upper left portion of the print-target image 3, and the printing apparatus 1 is being held by a user and is moved.

Together with the start of the printing, the sensor 30 measures a displacement of the printing apparatus 1 (step S102). Note that the start of printing in the step S101 may be executed after the step S102 and after the printing apparatus 1 is moved by a certain displacement.

When the displacement is measured, the position determiner 51 obtains the displacement measured by the sensor 30, and determines the position of the printing apparatus 1 relative to the print-target image 3 (step S103). The printing apparatus 1 prints a portion of the image 3 in accordance with the position of the printing apparatus 1 over the printing medium 2 and in accordance with the displacement.

When the position determiner 51 determines the position of the printing apparatus 1, the sensor selector 53 obtains the position of the printing apparatus 1 relative to the print-target image 3 which is determined by the position determiner 51, and determines whether or not the printing apparatus 1 traverses the reference line 4 (step S104). When a determination is made that the printing apparatus does not traverse (step S104: NO), the process progresses to step S106.

When a determination is made that the printing apparatus traverses (step S104: YES), the sensor selector 53 changes the sensor 30 that is sensing (step S105). That is, the state of the sensing sensor is changed to a deactivated state and the state of the deactivated sensor is changed to a sensing state among the sensors 30.

When the sensor selector 53 changes the sensing sensor 30, the displacement and direction of the printing apparatus 1 are continuously detected by the presently sensing sensor 30.

When the print-target image and corresponding to the position of the printer 20 is printed, the printing controller 52 determines whether or not all the portions of the print-target image 3 are printed (step S106). When a determination is made that all the portions of the image are not printed yet (step S106: NO), the process returns to the step S102.

When a determination is made that all the portions of the image are printed (step S106: YES), the printing process is completed.

The printing apparatus 1 according to Embodiment 1 which employs the above-described structure and which executes the printing process causes the sensor positioned at the center side of the print-target image 3 to execute the sensing among the sensors 30, and deactivates the sensor positioned at the external side. Hence, even if some sensors 30 positioned at the external side run over the printing medium 2, when the processor 50 determines that the printer head 22 of the printing apparatus 1 is still within the printing region of the printing medium 2 based on the sensing result by the other sensor 30 positioned at the center side, the printing is still continuable, and the print-target image 3 is printable without a blank space formed at the circumference edge of the printing medium 2 that is the printing region.

The printing apparatus 1 is capable of precisely and continuously detecting a change in the displacement of the printer 20 and a change in the angle thereof by changing the sensing state of the plurality of sensors 30 as needed, and thus the print-target image 3 is printable at an appropriate position in accordance with a user's free scanning of the printing apparatus 1. Simultaneously, by decreasing the number of sensing sensors, a power consumption by the printing apparatus 1 is reducible.

Embodiment 2

A printing apparatus 1 according to Embodiment 2 will be described with reference to the figures. The structure of the printing apparatus 1 according to Embodiment 2 is the same as that of the printing apparatus 1 according to Embodiment 1 illustrated in FIGS. 1 and 2.

Like Embodiment 1, the sensor selector 53 of the printing apparatus 1 according to Embodiment 2 changes the sensing sensor 30 when the printing apparatus 1 traverses the reference line 4. According to Embodiment 2, however, the reference line 4 includes a virtual reference line 4P that is a straight line which extends in the horizontal direction of the printing region where the image 3 is to be printed and which is apart from the upper edge of the printing region by a distance d toward the lower edge, a reference line 4Q that is a straight line which extends in the vertical direction of the printing area and which is apart from the right edge of the printing region by a distance d toward the left edge, a reference line 4R that is a straight line which extends in the horizontal direction of the printing region and which is apart from the lower edge of the printing region by a distance d toward the upper edge, and a reference line 4S that is a straight line which extends in the vertical direction of the printing region and which is apart from the left edge of the printing region by a distance d toward the right edge, thus different from that of Embodiment 1 such that the reference lines 4X and 4Y are excluded.

The respective distances d of the reference lines 4P and 4R are set to a distance that enables either one of the sensors 30A and 30C that is sensing at a moment immediately before the printing apparatus 1 traverses either one of the reference lines 4P and 4R to maintain the position within the printing region over the printing medium 2 and to maintain the state capable of sensing until a moment immediately before the printing apparatus 1 traverses the reference line 4 and the sensing state is changed to the deactivated state.

The respective distances d of the reference lines 4Q and 4S are set to a distance that enables either one of the sensors 30B and 30D that is sensing at a moment immediately before the printing apparatus 1 traverses either one of the reference lines 4Q and 4S to maintain the position within the printing region over the printing medium 2 and to maintain the state capable of sensing until a moment immediately before the printing apparatus 1 traverses the reference line 4 and the sensing state is changed to the deactivated state.

When equal to or greater than three sensors among the four sensor 30A to 30D are capable of sensing, the sensor selector 53 selects the two sensors among those sensors to maintain the sensing, and deactivates the remaining two sensors. The sensor selector 53 obtains the position of the printing apparatus 1 relative to the print-target image 3 from the position determiner 51, and selects, among the sensors 30, the sensor to execute the sensing and the sensor to be deactivated based on the obtained position.

FIGS. 7 to 11 are diagrams illustrating a positional relation between the printing apparatus 1 and the print-target image 3.

When the user starts moving the printing apparatus 1 in a printable state over the printing medium 2 in accordance with the determination by the position determiner 51, equal to or greater than the two sensors positioned over the printing medium 2 among the sensors 30 start measuring the displacement of the printing apparatus 1.

At this time, when there are equal to or greater than three sensors in a state capable of sensing and positioned over the printing medium 2, the sensor selector 53 controls in such a way that, along the moving direction, one sensor near the center of the printing region in the sensors 30A and 30C placed at the opposing positions to each other across the printer 20, and one sensor near the center of the printing region in the sensors 30B and 30D placed at the opposing positions to each other across the printer 20 continue the sensing, and the other sensors are deactivated. When both the sensors 30A and 30C are positioned over the printing medium 2, the sensor selectors 53 selects the one sensor only relatively near the printing region, and when only the one sensor is positioned over the printing medium 2, selects this one sensor only. Similarly, when both the sensors 30B and 30D are positioned over the printing medium 2, the sensor selector selects the one sensor only relatively near the printing region, and when only the one sensor is positioned over the printing medium 2, selects this one sensor only.

When both the sensors 30A and 30C are near the center to the same extent and positioned over the printing medium 2, the setting is made so as to cause the arbitrary one sensor to execute the sensing. Similarly, when both the sensors 30B and 30D are near the center to the same extent and positioned over the printing medium 2, the setting is made so as to cause the arbitrary sensor to execute the sensing.

Figure 7:
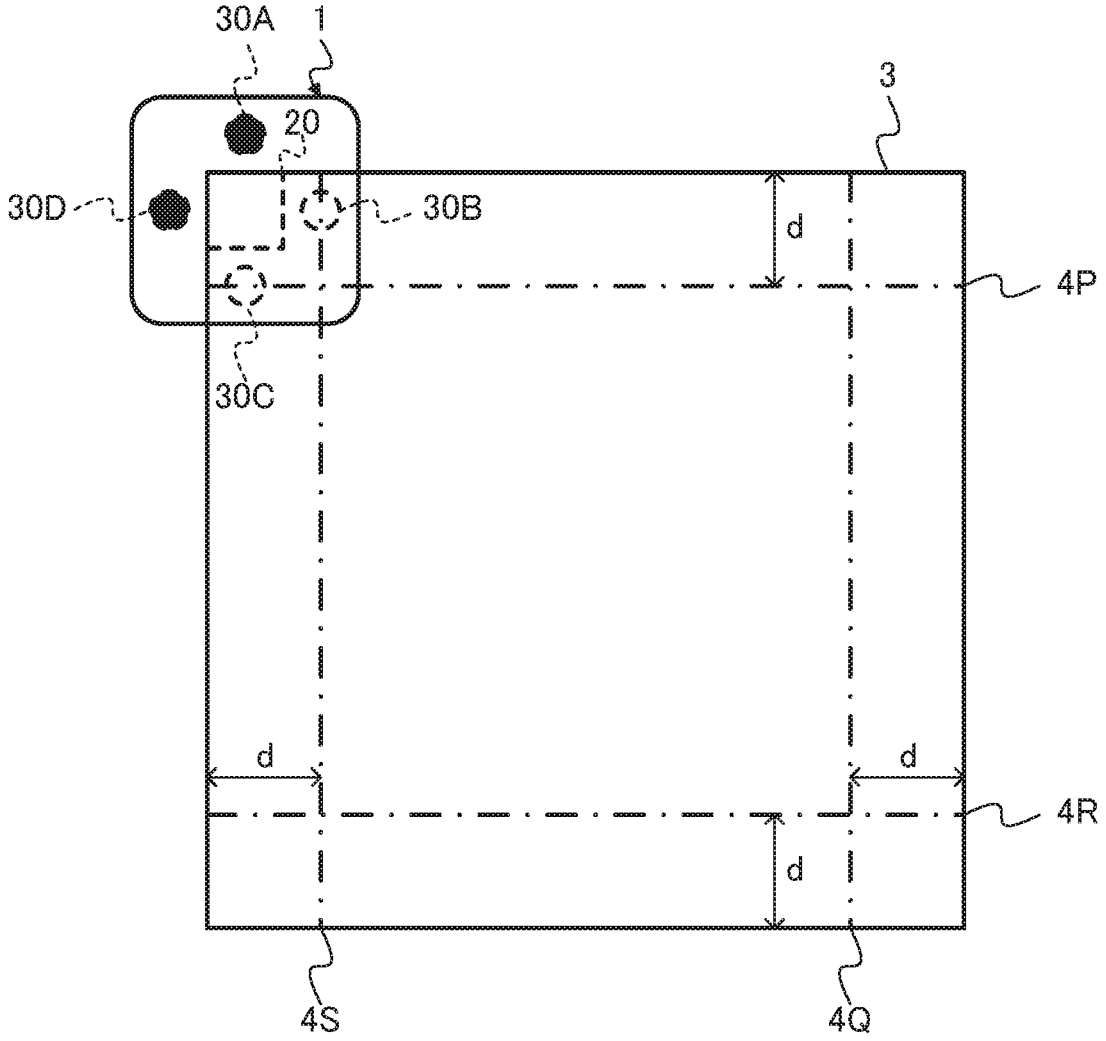
FIG. 7 is a diagram illustrating a positional relation between a printing apparatus and a print-target image according to Embodiment 2.

As illustrated in FIG. 7, according to the printing apparatus 1, like Embodiment 1, the processor 50 sets the initial position of the printing apparatus 1 to, for example, the upper left vertex of the print-target image 3, and the position determiner 51 determines the position of the printing apparatus 1 relative to the print-target image 3 by adding the displacement from the initial position.

In this case, the sensor selector 53 selects only the sensor 30C positioned relatively near the center of the printing region to execute the sensing, and deactivates the sensor 30A. Next, the sensor selector 53 selects only the sensor 30B positioned relatively near the center of the printing region to execute the sensing, and deactivates the sensor 30D.

Figure 8:
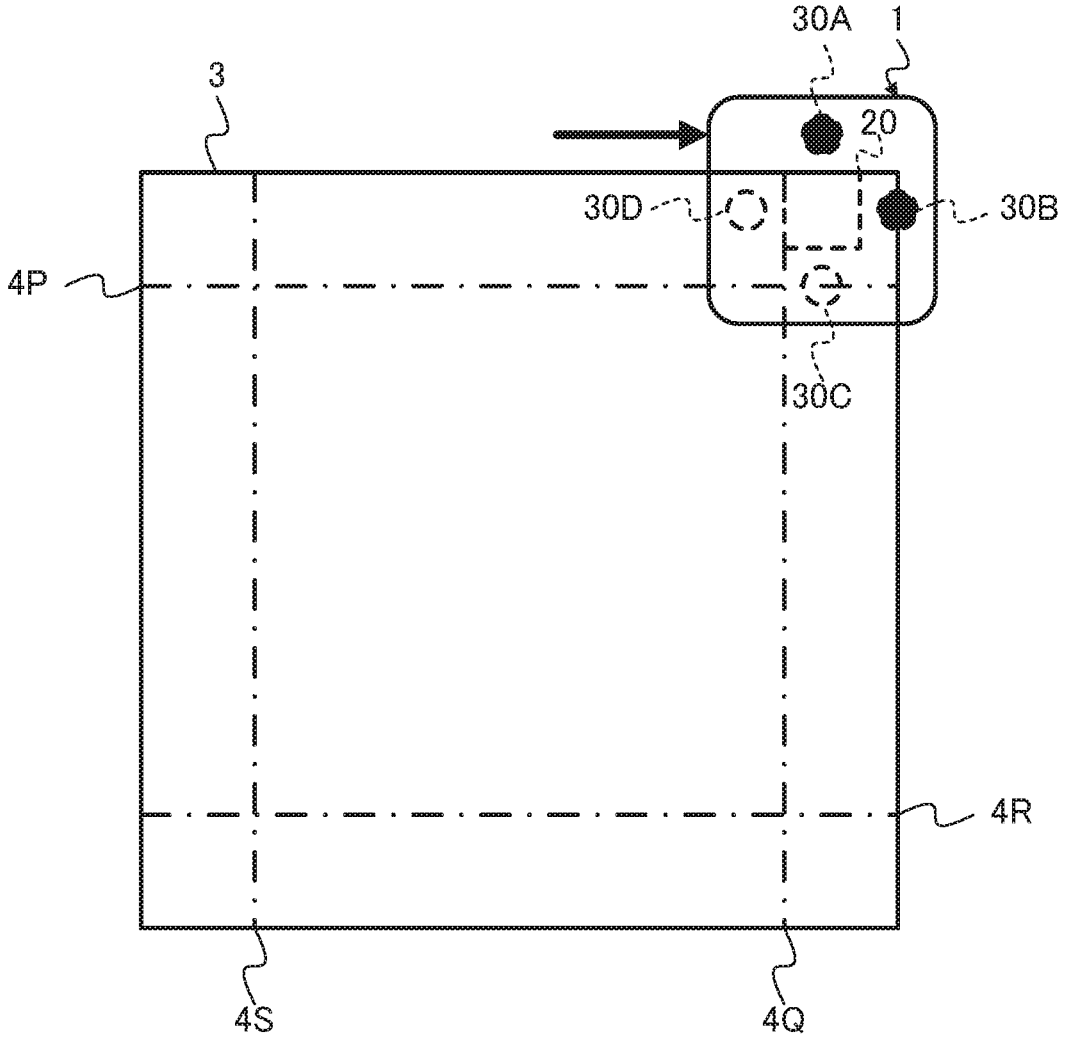
FIG. 8 is a diagram illustrating a positional relation between the printing apparatus and the print-target image according to Embodiment 2.

As illustrated in FIG. 8, when the user moves the printing apparatus 1 to the right side with the sensor 30B being sensing and the sensor 30D being deactivated, and the printing apparatus 1 traverses the reference line 4Q, the sensor selector 53 changes the deactivated sensor 30D positioned at the center side relative to the sensor 30B to execute the sensing, and changes the sensing sensor 30B positioned at the circumference edge side of the printing region relative to the sensor 30D so as to be deactivated.

Figure 9:
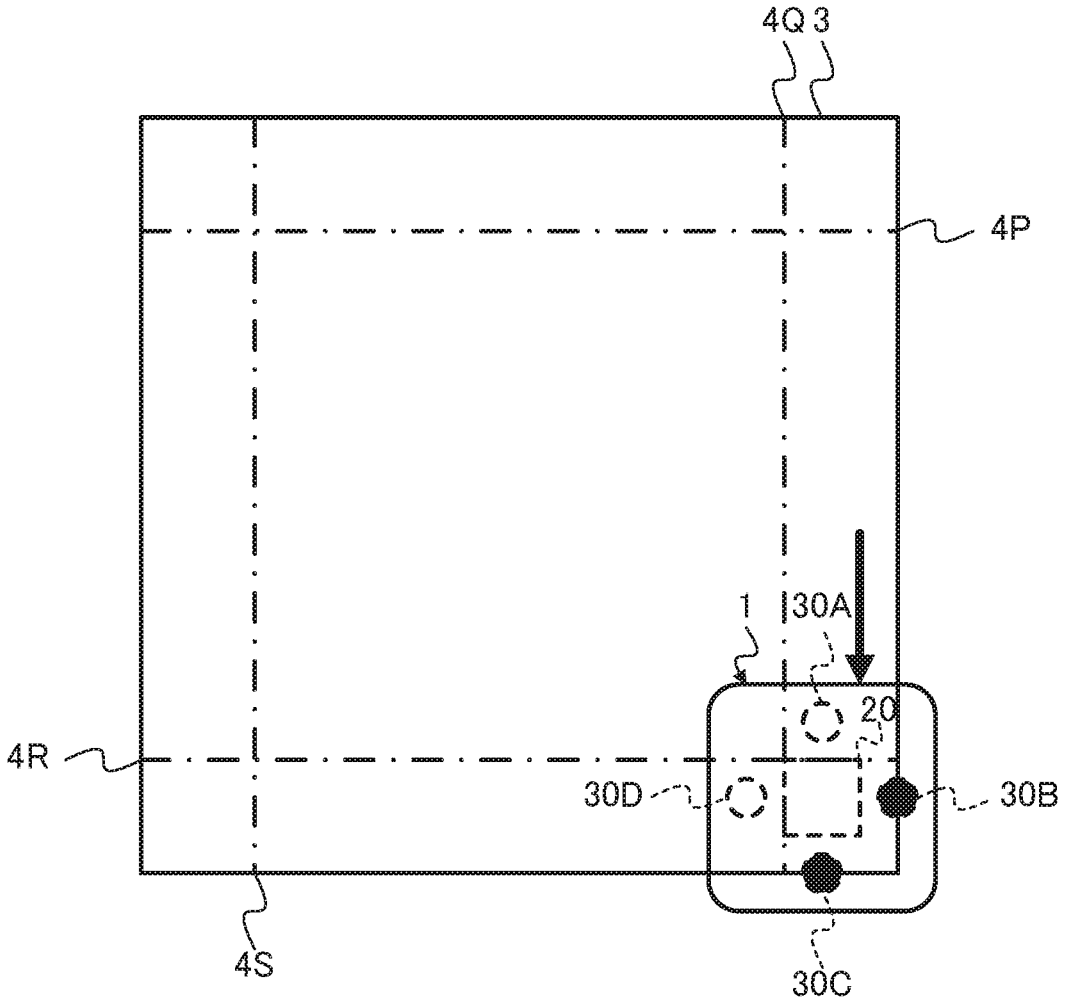
FIG. 9 is a diagram illustrating a positional relation between the printing apparatus and the print-target image according to Embodiment 2.

As illustrated in FIG. 9, when the user moves the printing apparatus 1 to the lower side with the sensor 30C being sensing and the sensor 30A being deactivated, and the printing apparatus 1 traverses the reference line 4R, the sensor selector 53 changes the deactivated sensor 30A positioned at the center side of the printing region relative to the sensor 30C to execute the sensing, and changes the sensing sensor 30C positioned at the circumference edge side of the printing region relative to the sensor 30A so as to be deactivated.

Figure 10:
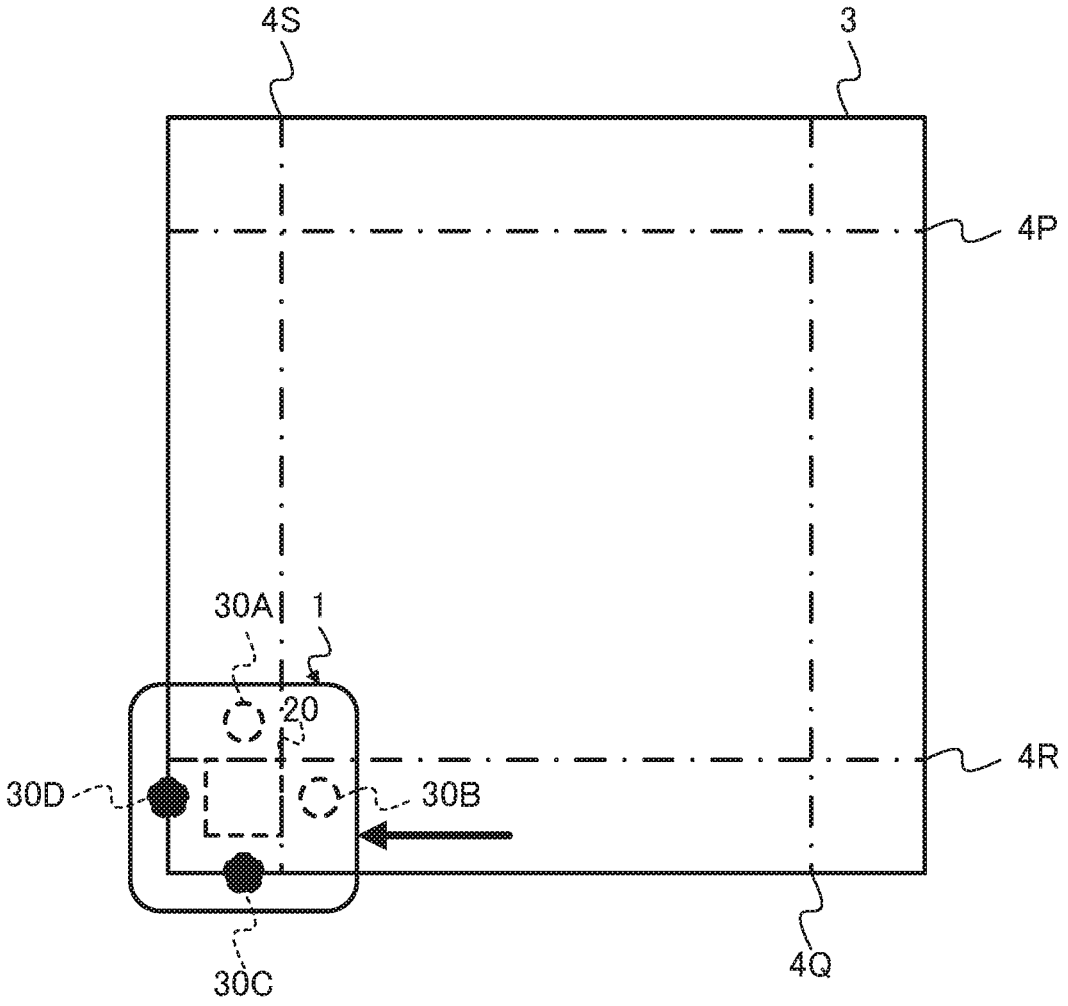
FIG. 10 is a diagram illustrating a positional relation between the printing apparatus and the print-target image according to Embodiment 2.

As illustrated in FIG. 10, when the user moves the printing apparatus 1 to the left side with the sensor 30D being sensing and the sensor 30B being deactivated, and the printing apparatus 1 traverses the reference line 4S, the sensor selector 53 changes the deactivated sensor 30B positioned at the center side of the printing region relative to the sensor 30D to execute the sensing, and changes the sensing sensor 30D positioned at the circumference edge side of the printing region relative to the sensor 30B so as to be deactivated.

Figure 11:
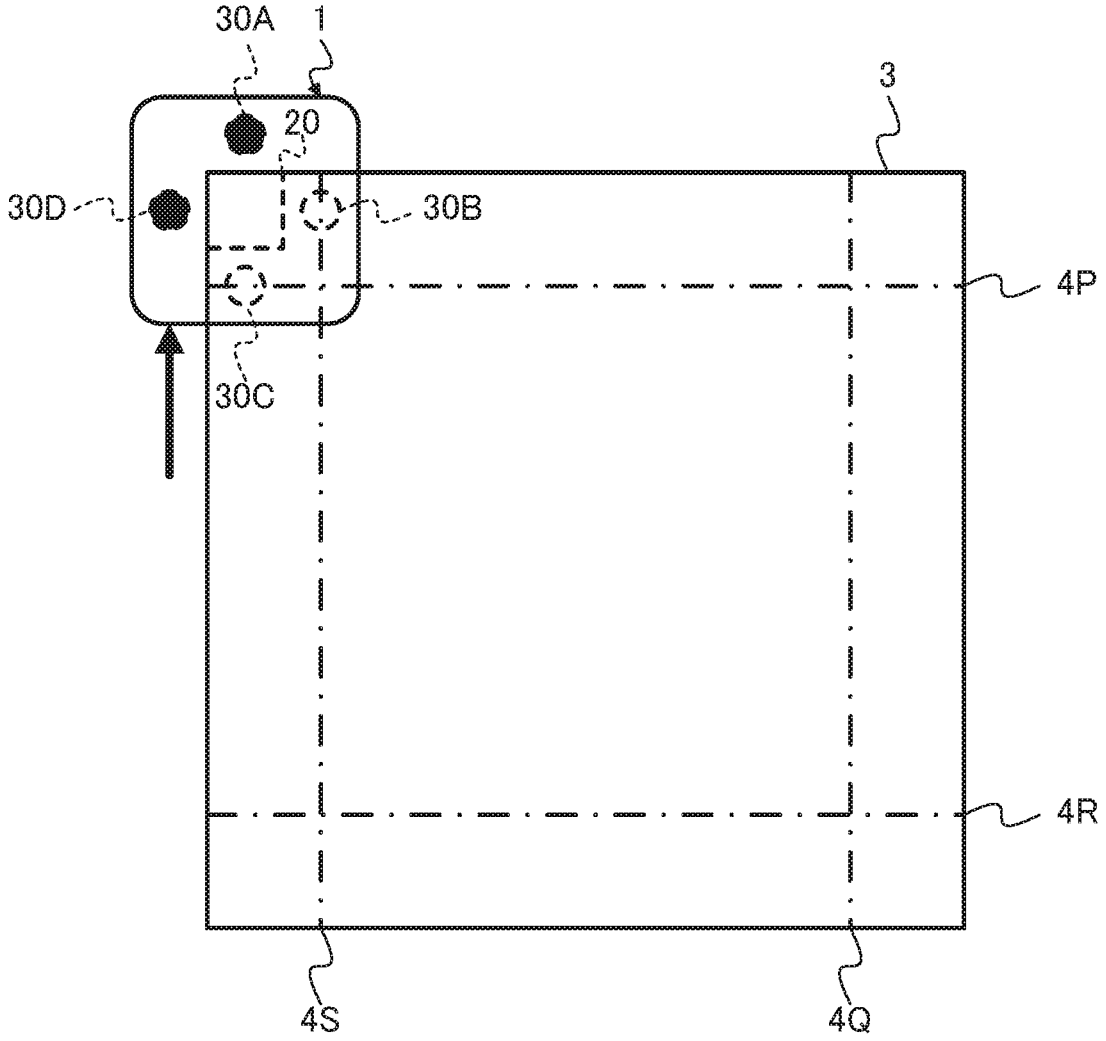
FIG. 11 is a diagram illustrating a positional relation between the printing apparatus and the print-target image according to Embodiment 2.

As illustrated in FIG. 11, when the user moves the printing apparatus 1 to the upper side with the sensor 30A being sensing and the sensor 30C being deactivated, and the printing apparatus 1 traverses the reference line 4P, the sensor selector 53 changes the deactivated sensor 30C positioned at the center side of the printing region relative to the sensor 30A to execute the sensing, and changes the sensing sensor 30A positioned at the circumference edge side of the printing region relative to the sensor 30C so as to be deactivated.

FIGS. 7 to 11 are diagrams illustrating a positional relation between the printing apparatus 1 and the print-target image 3. Note that in FIGS. 7 to 11, the white sensors among the sensors 30 indicate the sensors that executes the sensing, and the black sensors indicate the deactivated sensors. As illustrated in FIG. 7, in the upper left side of the print-target image 3 where the printing apparatus 1 starts printing, the sensor selector 53 causes the sensor 30B positioned at the right side of the printing apparatus 1 and the sensor 30C positioned at the lower side thereof to execute the sensing, and deactivates the sensor 30D positioned at the left side and the sensor 30A positioned at the upper side.

The printing apparatus 1 according to Embodiment 2 which employs the above structure and which executes the printing process is capable of avoiding a frequent change of the sensors 30 at the center part of the printing medium 2, thus avoiding a reduction in image printing quality in addition to the accomplishment of the advantageous effects accomplished by the printing apparatus 1 according to Embodiment 1.

Individual sensors 30 have individual differences, and when such sensors are changed, there is a possibility such that a coordinate may contain a minor error, and when the change of the sensors 30 is repeated, the error in coordinate is accumulated, possibly decreasing the image printing quality. The printing apparatus 1 according to Embodiment 2 changes the sensors 30 only at the circumference part of the print-target image 3, thereby decreasing the number of changes of the sensors 30, thus avoiding the reduction of the image printing quality.

Modified Example

Although the embodiments of the present disclosure have been described above, such embodiments are merely examples, and the applicable range of the present disclosure is not limited to these examples. That is, various modifications can be made to the embodiments of the present disclosure, and various embodiments are within the scope of the present disclosure.

Although the printer 20 includes the ink tank 21 and the printer head 22, and executes the printing by the inkjet scheme, the present disclosure is not limited to this example. The printing may be executed by various printing schemes, such as thermal printing and thermal transfer printing.

Although the sensor 30 includes the LED and the image sensor, and measures the displacement by causing the image sensor to read the light which is emitted from the LED and which is reflected by the printing medium 2, the present disclosure is not limited to this example. The sensor 30 may include rollers or balls placed on the lower surface of the casing 10, and may measure the displacement by measuring the rolling amount thereof. Moreover, the sensor may further include a laser light source, and may measure the displacement by causing the image sensor to read laser light which is emitted from the laser light source and which is reflected by the printing medium 2.

Although the sensor 30 includes the four sensor 30A to 30D, the present disclosure is not limited to this example. Regarding the sensor 30, equal to or greater than two, three or five sensors may be adopted.

Although the sensor selector 53 selects the sensor for sensing among the plurality of sensors 30 and deactivates the remaining sensors, the present disclosure is not limited to this example. The sensor selector 53 may cause all the sensors 30 to execute the sensing, select on sensor among the sensors 30 which has data to be a reference for the measurement of the displacement, utilize this data, and discard data from the other sensors.

Although the printing apparatus that includes the structure to achieve the functions according to the present disclosure in advance may be providable, an already-existing printing apparatus, and the like, may be caused to function as the printing apparatus of the present disclosure by applying a non-transitory storage medium. That is, by applying a non-transitory storage medium for achieving the functions of the printing apparatus exemplified in the embodiments and the modified examples so as to be executable by a CPU, or the like of the already-existing printing apparatus, the already-existing printing apparatus becomes able to function as the printing apparatus of the present disclosure. Moreover, a printing method according to the present disclosure is executable using a printing apparatus.

Moreover, such a non-transitory storage medium is an arbitrarily storage medium like a non-transitory computer-readable storage medium, such as a Compact Disc (CD)-ROM, a Digital Versatile Disc (DVD)-ROM, or a memory card. Furthermore, data may be superimposed on carrier waves using the non-transitory storage medium, and may be applied via a communication medium like the Internet. For example, a program on the non-transitory storage medium may be presented on a Bulletin Board System (BBS) over the communication network for distribution. Next, using this storage medium, by executing the program like other application programs under the control of an Operating System (OS), a structure capable of executing the above-described processes may be achieved.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A printing apparatus comprising:

a printer head that prints, in accordance with a movement of the printing apparatus by a user within a printing region of a printing medium, a print-target image on the printing medium;

a plurality of sensors each capable of sensing a displacement of the printing apparatus; and a processor that:

determines, based on the displacement sensed by at least one sensor among the plurality of sensors, a position of the printing apparatus relative to the printing region, and switches, among the plurality of sensors, a sensing state of a sensor that is sensing the displacement and a sensing state of a sensor that is not sensing the displacement, when the printing apparatus traverses a reference position on the print-target image in accordance with a movement operation of a user, wherein the reference position is at least one line apart from an edge of the print-target image by a predetermined distance.

2. The printing apparatus according to claim 1, wherein the processor controls, based on the position of the printing apparatus, the printer head to print the print-target image corresponding to a position of the printer head.

3. The printing apparatus according to claim 1, wherein the processor determines, as the position of the printing apparatus relative to the printing region, a position of a center of a lower surface of the printer head relative to the print-target image.

4. A printing apparatus, comprising:

a printer head that prints, in accordance with a movement of the printing apparatus by a user within a printing region of a printing medium, a print-target image on the printing medium;

a plurality of sensors each capable of sensing a displacement of the printing apparatus; and a processor that:

determines, based on the displacement sensed by at least one sensor among the plurality of sensors, a position of the printing apparatus relative to the printing region, and switches, among the plurality of sensors, a sensing state of a sensor that is sensing the displacement and a sensing state of a sensor that is not sensing the displacement, in accordance with the determined position of the printing apparatus, wherein the plurality of sensors comprises four sensors, and the processor selects, in accordance with the position of the printing apparatus, from among the four sensors, two sensors as sensors for sensing the displacement and the two remaining sensors as sensors not for sensing the displacement.

5. A printing apparatus comprising:

a printer head that prints, in accordance with a movement of the printing apparatus by a user within a printing region of a printing medium, a print-target image on the printing medium;

a plurality of sensors each creating data on a displacement of the printing apparatus in accordance with each sensing result thereof; and a processor determining the displacement, wherein the processor:

determines a position of the printing apparatus relative to the printing region based on the data on the displacement sensed by a sensor among the plurality of sensors, and changes the plurality of sensors so as to stop utilizing the data newly created from the sensor that is creating the data utilized by the processor to determine the displacement, and to start utilizing, for a determination on the displacement by the processor, the data newly created from the sensor that was creating the data not utilized, when the printing apparatus traverses a reference position on the print-target image in accordance with a movement operation of a user, wherein the reference position is at least one line apart from an edge of the print-target image by a predetermined distance.

6. The printing apparatus according to claim 5, wherein the processor controls, based on the position of the printing apparatus, the printer head to print the print-target image corresponding to a position of the printer head.

7. The printing apparatus according to claim 5, wherein the processor determines, as the position of the printing apparatus relative to the printing region, a position of a center of a lower surface of the printer head relative to the print-target image.

8. A printing apparatus comprising:

a printer head that prints, in accordance with a movement of the printing apparatus by a user within a printing region of a printing medium, a print-target image on the printing medium;

a plurality of sensors each creating data on a displacement of the printing apparatus in accordance with each sensing result thereof; and a processor determining the displacement, wherein the processor:

determines a position of the printing apparatus relative to the printing region based on the data on the displacement sensed by a sensor among the plurality of sensors, and changes the plurality of sensors so as to stop utilizing the data newly created from the sensor that is creating the data utilized by the processor to determine the displacement, and to start utilizing, for the determination on the displacement by the processor, the data newly created from the sensor that was creating the data not utilized, in accordance with the determined position of the printing apparatus, wherein the plurality of sensors comprises four sensors, and the processor changes the plurality of sensors so as to stop utilizing the data newly created from two of the four sensors that are creating the data utilized by the processor to determine the displacement, and to start utilizing, for the determination on the displacement by the processor, the data newly created from the remaining two sensors that were creating the data not utilized, in accordance with the position of the printing apparatus.

9. A printing method of a printing apparatus, the method comprising:

sensing a displacement of the printing apparatus within a printing region of a printing medium;

determining a position of the printing apparatus relative to the printing region based on the sensed displacement;

changing a first sensor that is sensing so as to be deactivated, and changing a second sensor that is not sensing while the first sensor is sensing so as to execute the sensing, in accordance with the determined position of the printing apparatus; and printing a print-target image in accordance with a position of the printing apparatus within the printing region.

10. A non-transitory computer-readable storage medium storing a program of a printing apparatus, the program causing a computer to:

cause a first sensor to sense a displacement of the printing apparatus within a printing region of a printing medium;

determine a position of the printing apparatus relative to the printing region based on the sensed displacement;

change the first sensor that is sensing so as to be deactivated, and change a second sensor that is not sensing while the first sensor is sensing so as to execute the sensing, in accordance with the determined position of the printing apparatus; and print a print-target image in accordance with a position of the printing apparatus within the printing region.

* * * * *